US005329670A

United States Patent [19]

Huang

[11] Patent Number: 5,329,670

[45] Date of Patent: Jul. 19, 1994

[54] STRUCTURE OF CLIP

[76] Inventor: Yu-Hwei Huang, No. 7, Alley 2, Lane 85, Min Tsu Rd., Lu Chou Hsiang, Taipei Hsien, Taiwan

[21] Appl. No.: 176,581

[22] Filed: Dec. 30, 1993

[51] Int. Cl.[5] ..... A45F 5/00

[52] U.S. Cl. ..... 24/3 K; 24/3 R; 24/343; 224/252

[58] Field of Search ..... 24/3 K, 3 R, 3 G, 3 J, 24/3 L, 49 CC, 343; 70/456 R, 459; 224/252, 269

[56] References Cited

U.S. PATENT DOCUMENTS 845,743 3/1907 Bindner ..... 24/3 K
2,600,563 6/1952 Michnoff ..... 24/3 K
4,237,583 12/1980 Sullivan ..... 224/252
4,358,036 11/1982 Maltais ..... 224/252
5,129,126 7/1992 Huang ..... 24/3 K

*Primary Examiner*—Victor N. Sakran
*Attorney, Agent, or Firm*—Pro-Techtor International

[57] ABSTRACT

A clip includes a casing consisted of a face panel and a back panel joined at one end, and a clamping spring plate fastened to the face panel, wherein the face panel has an inside track and an outside track on two opposite sides thereof and a stub rod raised from the outside track; the clamping spring plate has one end formed into a chuck chucked on the inside and outside tracks and an arched free end stopped against the back panel inside the casing, the chuck-like fixed end of the clamping spring plate having a pin hole, which receives the stub rod on the outside track.

4 Claims, 7 Drawing Sheets

STRUCTURE OF CLIP

BACKGROUND OF THE INVENTION

The present invention relates to clips used for holding things together or for holding key chains.

Various clips have been disclosed for fastening to the belt to hold a key ring, and have appeared on the market. FIG. 1 shows a conventional clip for this purpose. As illustrated, the clip comprises a casing consisted of a back panel 10 and a face panel 11 joined at one end, and a clamping spring plate 12 fastened to the casing on the inside. The clamping spring plate 12 has a bottom end 15 fastened to the face panel 11 by a rivet 16, and a top end 13 curved downwards and stopped against the inside wall 14 of the back panel 10. This structure of clip is not satisfactory in use. When the clip is fastened to the belt, the sharp edge of the curved top end of the clip may damage the clothes. Another drawback of this structure of clip is its complicated assembly process. Because the clamping spring plate is fastened to the casing by a rivet, a special processing process is needed.

BACKGROUND OF THE INVENTION

The present invention eliminates the aforesaid drawbacks. It is therefore an object of the present invention to provide a clip which is easy to assemble. It is another object of the present invention to provide a clip which does not causes any damage to the things inserted.

According to one aspect of the present invention, the clip comprises a casing consisted of a face panel and a back panel joined at one end, and a clamping spring plate fastened to the face panel, wherein the face panel has an inside track and an outside track on two opposite sides thereof and a stub rod raised from the outside track; the clamping spring plate has one end formed into a chuck chucked on the inside and outside tracks and an arched tail stopped against the back panel inside the casing, the chuck-like fixed end of the clamping spring plate having a pin hole, which receives the stub rod on the outside track.

According to another aspect of the present invention, the casing has a top chamber which receives the tip end of the arched tail of the clamping spring plate to prohibit the tip end from damaging the thing being inserted into the casing.

DETAILED DESCRIPTION OF THE PREFERRED EMBODIMENTS

Figure 1:
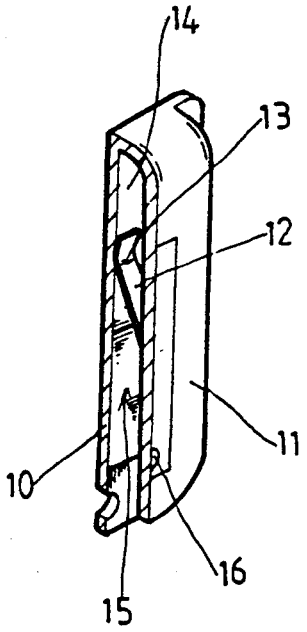
PRIOR ART FIG. 1
FIG. 1 is a sectional view of a clip according to the prior art.
Figure 2:
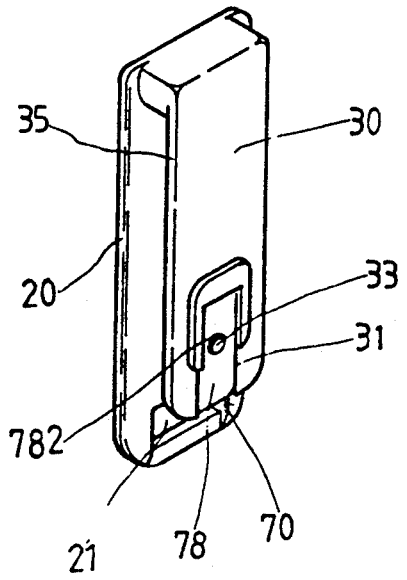
FIG. 2 is an elevational view of a clip according to one embodiment of the present invention.

Referring to FIG. 2, the casing (clip body) of a clip according to the present invention is comprised of a back panel 20 and a face panel 30 joined at one end. The back panel 20 is made longer than the face pane 130, having a hanging hole 21 on the bottom end thereof for hanging. A top chamber 200 is defined within the back panel 20 and the face panel 30 at the top (see FIG. 3).

Figure 3:
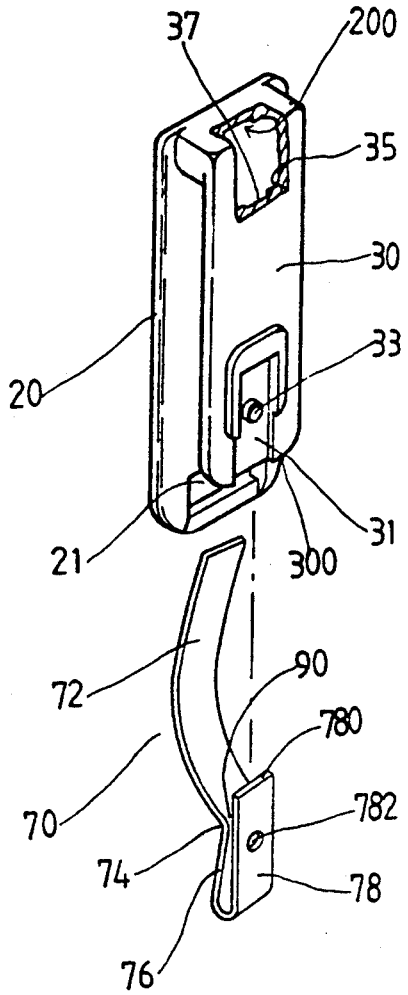
FIG. 3 is an exploded view of the clip shown in FIG. 2.

Referring to FIG. 3 and FIG. 2 again, the face panel 30 has a longitudinal outside track 31 on the outside longitudinally extended to the bottom side 300 thereof, a stub rod 33 raised from the outside track 31 at a suitable location, an inside track 37 longitudinally disposed on the inside wall 35 thereof along the length. A clamping spring plate 70 is fastened to the face panel 30 for holding things. The clamping spring plate 70 comprises an elongated, arched clamping portion 72, a vertical mounting portion 78, a curved connecting portion 76 connected between the clamping portion 72 and the mounting portion 78, a bend 74 connected between the connecting portion 76 and the clamping portion 72, wherein the top end 780 of the vertical mounting portion 78 is disposed at a higher elevation than the bend 74; the gap 90 between the bend 74 and the vertical mounting portion 78 is narrower than the thickness of the outside track 31 on the face panel 30 of the clip body; the vertical mounting portion 78 has a pin hole 782 at a suitable location. The mounting portion 78 of the clamping spring plate 74 is fastened to the outside track 31 of the clip body by inserting the bottom side 300 through the gap 90 permitting the mounting portion 78 and the connecting portion 76 to engage into the outside track 31 and the inside track 37 respectively, and then inserting the stub rod 33 into the pin hole 782. The width of the connecting portion 76 fits the width of the inside track 37. When installed, the arched clamping portion 72 is received in the top chamber 200 and stopped at the inside wall of the back panel 20.

Figure 4:
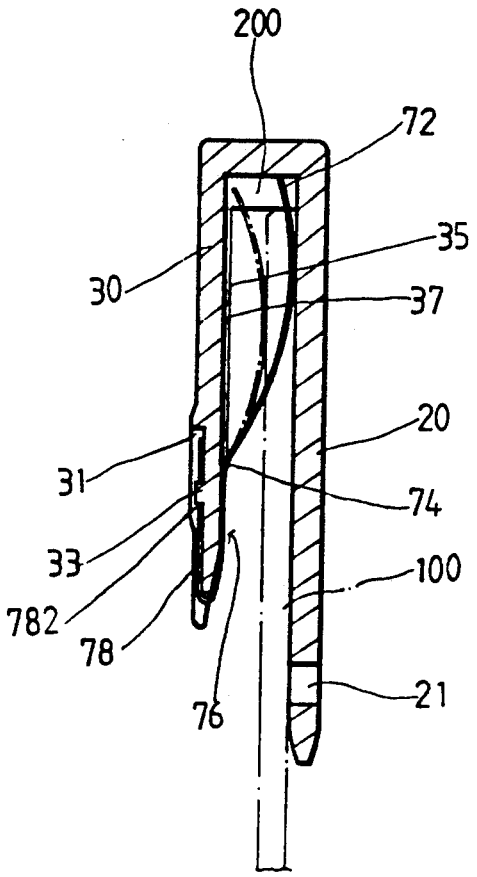
FIG. 4 is a longitudinal view in section of the clip shown in FIG. 2.

Referring to FIG. 4, when the clip is fastened to a belt 100, the arched clamping portion 72 moved away from the inside wall of the back panel 20 for letting the belt 100 to pass. When passed, the arched clamping portion 72 gives a pressure to the belt 100, and therefore the clip is firmly retained to the belt 100. Because the top end of the arched clamping portion 72 moves in the top chamber 200, it does not damage the clothes when the clip is hung on the belt.

Figure 5:
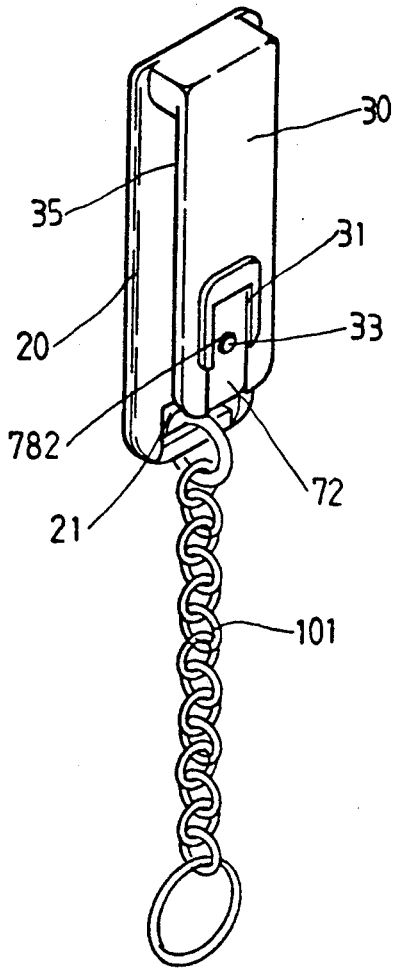
FIG. 5 shows the clip of FIG. 2 fastened with a key chain.

Referring to FIG. 5, a key chain 101 may be hung on the hanging hole 21 to hold a bunch of keys, and therefore the clip is served as a key chain holder.

Figure 6:
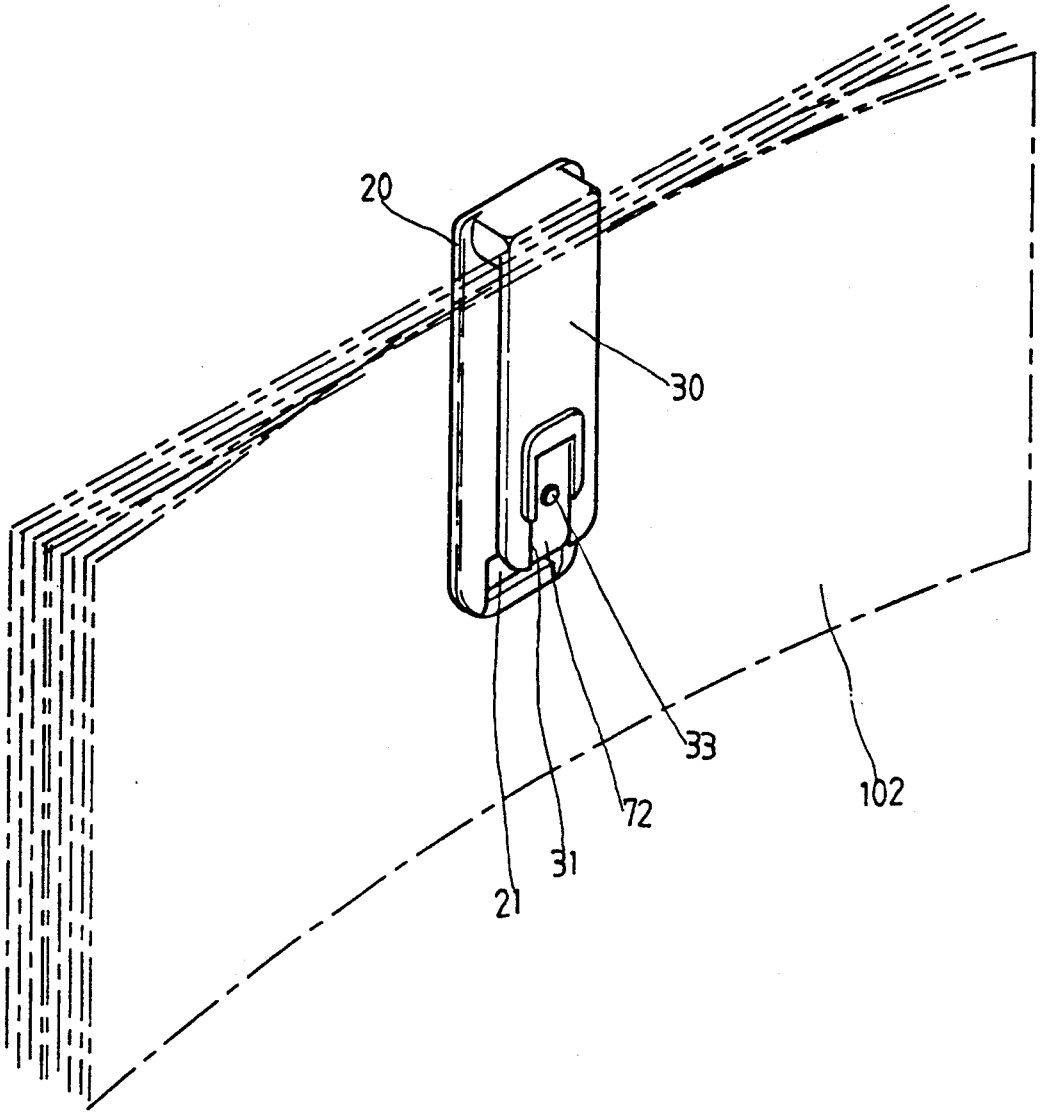
FIG. 6 shows the clip of FIG. 2 fastened to a stack of paper.

Referring to FIG. 6, the clip of the present invention can also be used to hold a stack of paper together.

Figure 7:
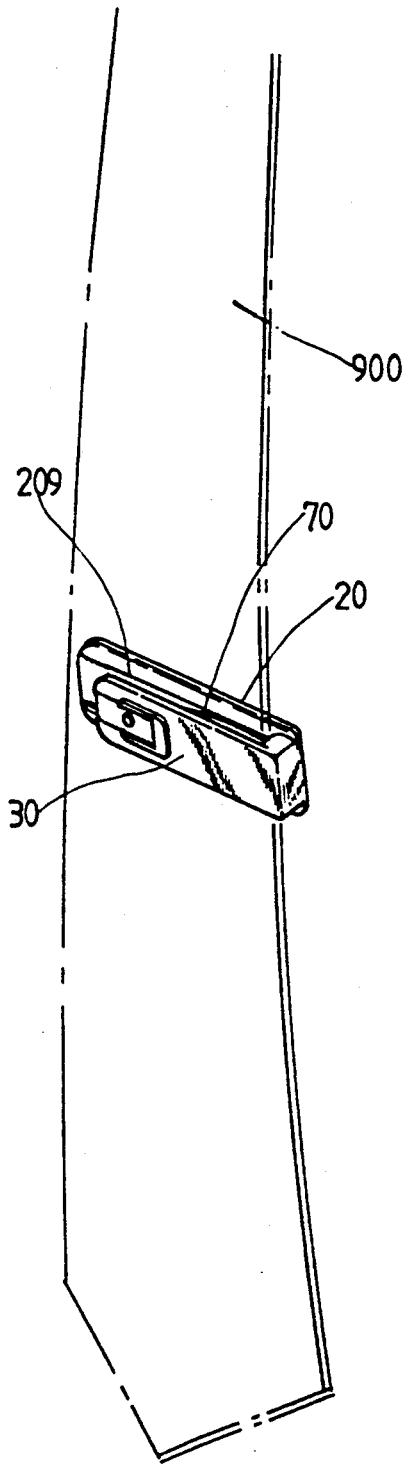
FIG. 7 shows an alternate form of the clip of the present invention fastened to a necktie.

Referring to FIG. 7, therein illustrated is an alternate form of the present invention designed for use as a necktie clip to fasten a necktie 900. In this alternate form, the back panel 20 has a recessed area 209 on the back wall thereof. When the clip is fastened to the necktie 900, part of the cloth of the necktie 900 can be inserted into the recessed area 209 to stabilize the position of the clip on the necktie.

While only few embodiments of the present invention have been shown and described, it will be understood that various modifications and changes could be made without departing from the spirit and scope of the invention.

What is claimed is:

1. A clip comprising a casing having a face panel and a back panel joined at one end, said back panel having a hanging hole on a bottom end thereof, said face panel comprising an inside track and an outside track on two opposite sides thereof and a stub rod raised from said outside track; and a clamping spring plate fastened to said casing for holding things, said clamping spring plate comprising an elongated, arched clamping portion disposed between said front and back panels of said casing and stopped against an inside wall of said back panel and terminating in a free end, a vertical mounting portion mounted on said outside track, said mounting portion having a pin hole, which receives said stub rod, a curved connecting portion connected between said clamping portion and said mounting portion and mounted on said inside track.

2. The clip of claim 1 wherein said inside track of said face panel of said casing fits the width of said connecting portion of said clamping spring plate.

3. The clip of claim 1 wherein said casing further comprises a top chamber inside the connecting area between said face panel and said back panel to receive the free end of said clamping portion of said clamping spring plate.

4. The clip of claim 1 wherein said back panel further comprising a recessed area on the inside wall thereof.

* * * * *